US006742682B2

(12) United States Patent
Batschied et al.

(10) Patent No.: US 6,742,682 B2
(45) Date of Patent: Jun. 1, 2004

(54) DRIP-FREE NOZZLE WITH A FIXED JET DIRECTION

(75) Inventors: Karl Batschied, Wilhelmsfeld (DE); Kurt Oberhofer, Wilhelmsfeld (DE)

(73) Assignee: Oberhofer Werkzeugbau GmbH (DE)

( * ) Notice: Subject to any disclaimer, the term of this patent is extended or adjusted under 35 U.S.C. 154(b) by 0 days.

(21) Appl. No.: 10/312,897

(22) PCT Filed: May 7, 2002

(86) PCT No.: PCT/DE02/01644

§ 371 (c)(1),
(2), (4) Date: Dec. 30, 2002

(87) PCT Pub. No.: WO02/090239

PCT Pub. Date: Nov. 14, 2002

(65) Prior Publication Data

US 2003/0178449 A1 Sep. 25, 2003

(30) Foreign Application Priority Data

May 8, 2001 (DE) ..... 101 22 289

(51) Int. Cl.[7] ..... B65D 47/00
(52) U.S. Cl. ..... 222/559; 222/522; 251/351
(58) Field of Search ..... 222/559, 549, 222/548, 538, 525, 523, 522, 519, 518, 185.1, 153.05, 153.06, 153.14; 251/351, 349, 348, 325; 137/312; 141/348, 349

(56) References Cited

U.S. PATENT DOCUMENTS 1,629,303 A * 5/1927 Clive ..... 222/519
1,912,304 A * 5/1933 Clive ..... 222/513
2,751,119 A * 6/1956 Manning, Sr. ..... 222/81
3,493,146 A * 2/1970 Conners et al. ..... 222/153.06
4,351,455 A * 9/1982 Bond ..... 222/153.14
4,802,610 A * 2/1989 Cheek et al. ..... 222/481.5
5,379,922 A * 1/1995 Paradoski ..... 222/153.06
6,053,475 A * 4/2000 Batschied et al. ..... 251/351
6,260,823 B1 * 7/2001 Weber ..... 251/351

FOREIGN PATENT DOCUMENTS

| | | |
|---|---|---|
| AU | 621387 | 3/1992 |
| DE | 554131 | 6/1932 |
| DE | 29821780 | 2/1999 |
| DE | 29914981 | 12/1999 |

OTHER PUBLICATIONS

International Search Report from PCT/DE02/01644.

* cited by examiner

*Primary Examiner*—Michael Mar
*Assistant Examiner*—Frederick C. Nicolas
(74) *Attorney, Agent, or Firm*—Galgano & Burke, LLP

(57) ABSTRACT

The tap has a tap bushing (10) with a passage opening (34) for the liquid to be discharged. A piston (12) is guided so as to move axially within the tap bushing (10) and has an entry opening (36) and an exit opening (38) for the liquid. The piston (12) closes off the passage opening (34) in a locked position when it is moved in. The entry opening (36) of the piston (12) is in connection with the passage opening (34) in an extended position of the piston (12). A locking bushing (14) that is guided to rotate on the piston (12) is seated in the piston (12), which locking bushing (14) optionally closes off the exit opening (38) or brings it into connection with a passage opening (44) of the locking bushing (14).

18 Claims, 3 Drawing Sheets

DRIP-FREE NOZZLE WITH A FIXED JET DIRECTION

Figure 1:
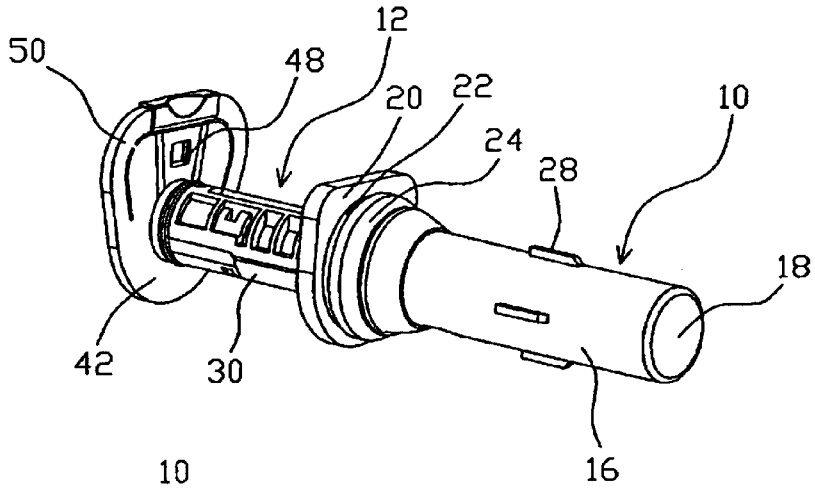

The invention relates to a tap for discharging liquid from a container, with a tap bushing that can be set into an opening in the container, with a seal, which tap bushing is provided with a passage opening for the liquid, and with a piston guided so as to move axially within the tap bushing, which piston has an entry opening and an exit opening for the liquid, whereby the piston closes off the passage opening of the tap bushing in a locked position when it is moved into the tap bushing, and whereby the entry opening of the piston is in connection with the passage opening of the tap bushing in an extended position of the piston, in which it is moved out of the tap bushing, and a flow path through the piston can be released and blocked off by means of rotational activation.

Such a tap is known from DE 198 25 929 A1. The tap is designed for a rotational activation of the piston. When the piston is moved out of the tap bushing, it can be rotated from the locked position in which it closes off the passage opening of the bunghole bushing, into a release position in which the entry opening of the piston is in connection with the passage opening of the tap bushing, and vice versa. In the release position, liquid exits from the exit opening of the piston, which functions as the discharge opening of the tap.

The tap of DE 198 25 929 A1 is of a mature design that has been well proven in practice. The tap is particularly characterized by a high level of operational reliability and a high level of operating ease. Cost-effective production and assembly of the tap are guaranteed because it is composed of only two parts.

The known tap is primarily used to discharge liquids that contain carbon dioxide and have been packaged under pressure, particularly beverages, from barrels, small barrels (party barrels), or cans. What is particularly involved is party barrels for beer.

It is felt to be a disadvantage of the known tap that it drips when discharging liquids that contain carbon dioxide and have been packaged under pressure. When the tap is first opened, the interior of the tap bushing and the cavity of the piston fill with liquid. When the tap is closed, a residue of liquid remains in the tap bushing and the piston, downstream from the passage opening of the tap bushing. The carbon dioxide contained in the residue of liquid relaxes and allows more liquid to exit from the tap. This is the known dripping effect.

It is understood that dripping is undesirable, since it can result in stains, and hygiene problems can occur.

Another disadvantage of the known tap is that when the piston is activated by rotation, the discharge direction of the liquid being discharged changes. It should be noted that the change is not great, but it can make it more difficult to fill small and slender vessels.

It is the task of the invention to create a tap of the type stated initially, which is free of any dripping and has a fixed discharge direction, while changing the design as little as possible, keeping the outside dimensions practically the same and, very important, offering the same type of operation. The new tap is supposed to be able to replace the tap of DE 198 25 929 A1, with the user practically not noticing the difference, only that the tap does not drip and that the discharge direction is not influenced by the rotational activation.

This task is accomplished, with such a tap, in that a locking bushing that is guided to rotate on the piston is seated in the piston, which locking bushing has a passage opening and can be rotated from a locked position in which it closes off the exit opening of the piston, into a release position in which the exit opening of the piston is in connection with the passage opening, and vice versa.

According to the invention, the exit opening of the piston is closed or released, respectively, by rotational activation of a locking bushing seated in it. In the locked position of the locking bushing, liquid that is located in the tap cannot exit, i.e. the tap cannot drip.

The exit opening of the piston functions as the discharge opening of the tap. Since it is not the piston but rather the locking bushing that is rotated within it, the discharge direction of the tap remains unchanged during the rotational activation.

In the tap according to the invention, the piston can be moved solely in an axial direction. In other words, no rotational adjustment of the piston is provided. This makes it possible to simplify the structure of the piston.

In the tap according to the invention, the rotational adjustment of the locking bushing is uncoupled from the axial adjustment of the piston. The user can therefore pull the piston out of the tap bushing and rotate the locking bushing in the piston, independently of one another. Incorrect operation cannot occur in this connection, since liquid exits from the tap only if the piston has been pulled sufficiently far out of the tap bushing, and if the locking bushing has been rotated sufficiently far in the piston.

The tap according to the invention is made of three parts and is therefore somewhat more complicated in its production and assembly than the two-part tap according to DE 198 25 929 A1. The accompanying somewhat higher production and assembly costs are more than made up by the advantage that it does not drip and that the discharge direction is fixed.

Compared with the tap according to DE 198 25 929 A1, there are no increased requirements with regard to originality protection for the tap according to the invention.

In a preferred exemplary embodiment, the entry opening and the exit opening of the piston lie on its bottom in a common radial plane. This structure is made possible by the purely axial adjustment of the piston in the tap bushing. In this way, a simplified construction of the piston and a discharge direction precisely downward are achieved.

In a preferred embodiment, the piston has a contact stop to limit its extended position out of the tap bushing.

In a preferred embodiment, the locking bushing is limited by a contact stop that limits its rotational movement in the piston, towards both sides.

In a preferred embodiment, a shield is provided on the outer face of the locking bushing, and a handle stirrup is divided from this shield.

In a preferred embodiment, the handle stirrup is provided with an elastic covering. In this way, the ease of operation of the tap and its value appeal are significantly increased for the user.

In a preferred embodiment, the covering of the handle stirrup is textured on its surface, in such a way as to improve its feel, particularly it is provided with ribs or ridges. This increases the ease of operation of the tap.

In a preferred embodiment, the covering is molded onto the handle stirrup using two-component injection-molding technology. This is preferred for cost reasons.

In a preferred embodiment, the handle stirrup is connected to the tap bushing at at least one predetermined breaking point. The connection consists of the elastic material of the covering. This also serves to increase the ease of operation.

Figure 2:
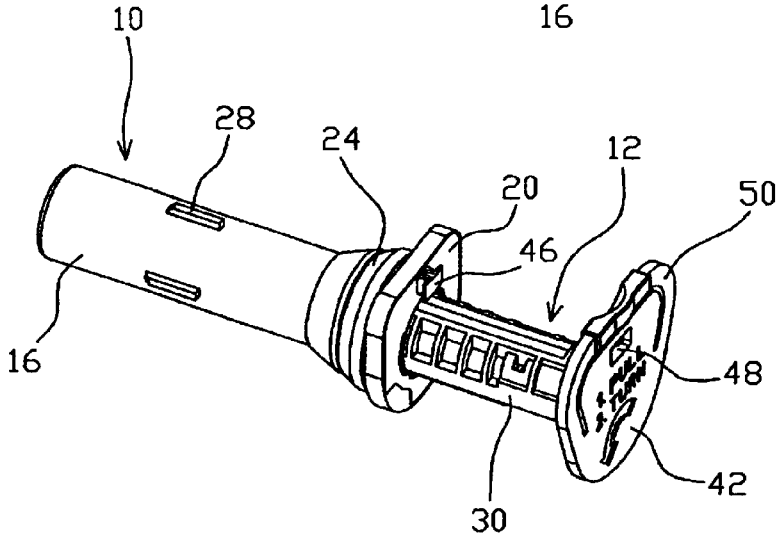
Figure 3:
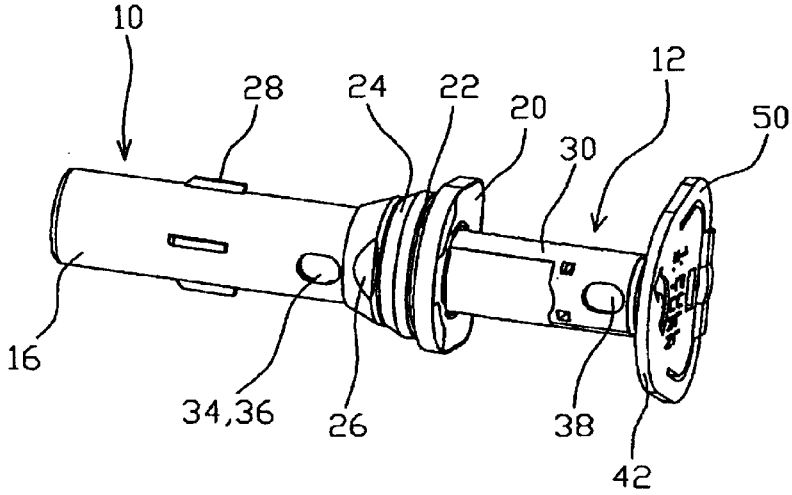
Figure 4:
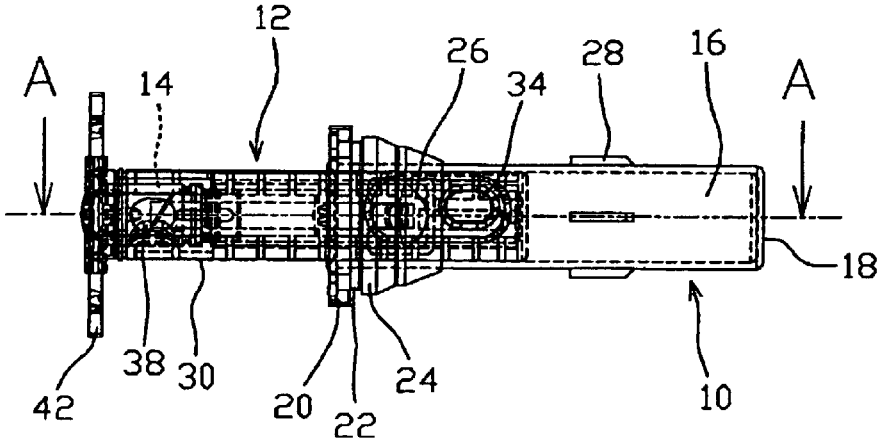
Figure 5:
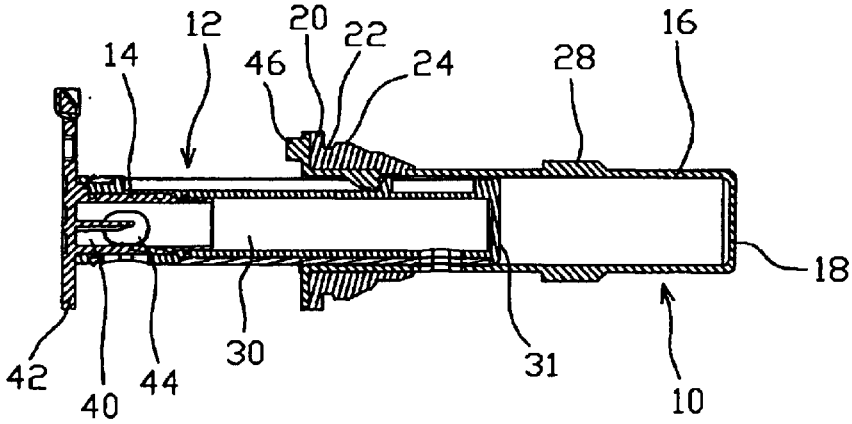
Figure 6:
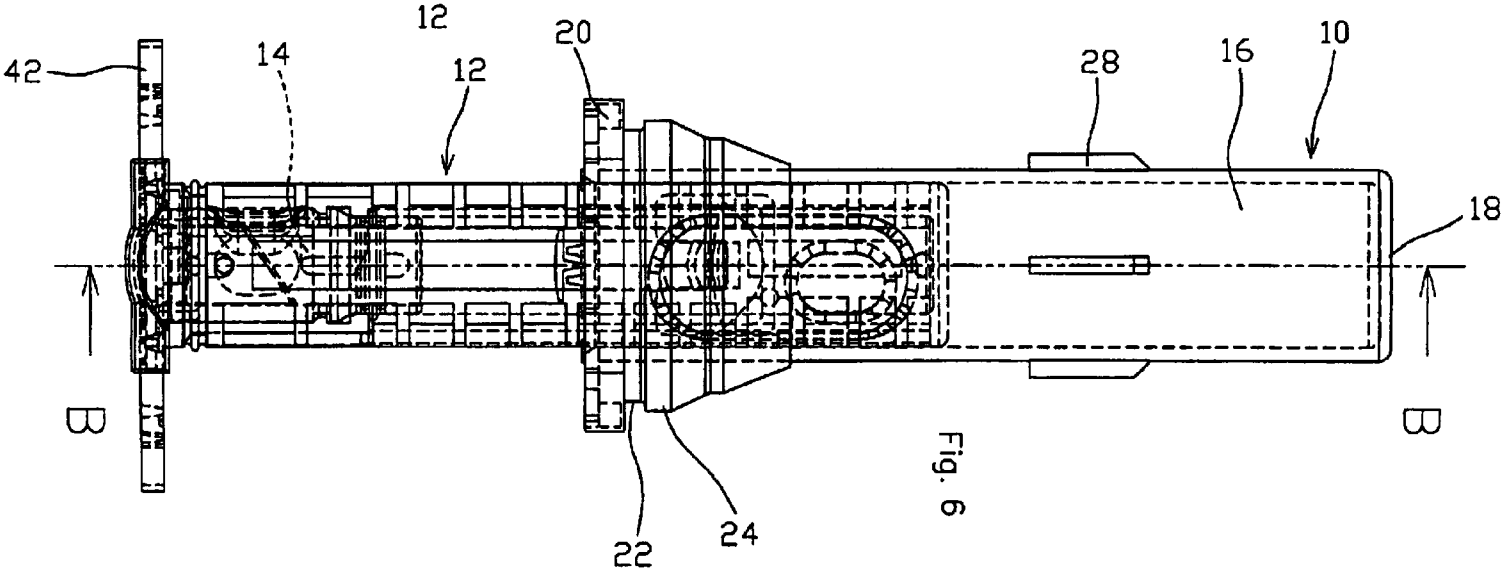

The invention will be explained in greater detail below, on the basis of an exemplary embodiment shown in the drawing. This shows:

FIG. 1 to FIG. 3, perspective views of a tap;

FIG. 4 a first side view of the tap;

FIG. 5 a cross-section through the tap along A—A of FIG. 4;

FIG. 6 a second side view of the tap, on a larger scale; and

Figure 7:
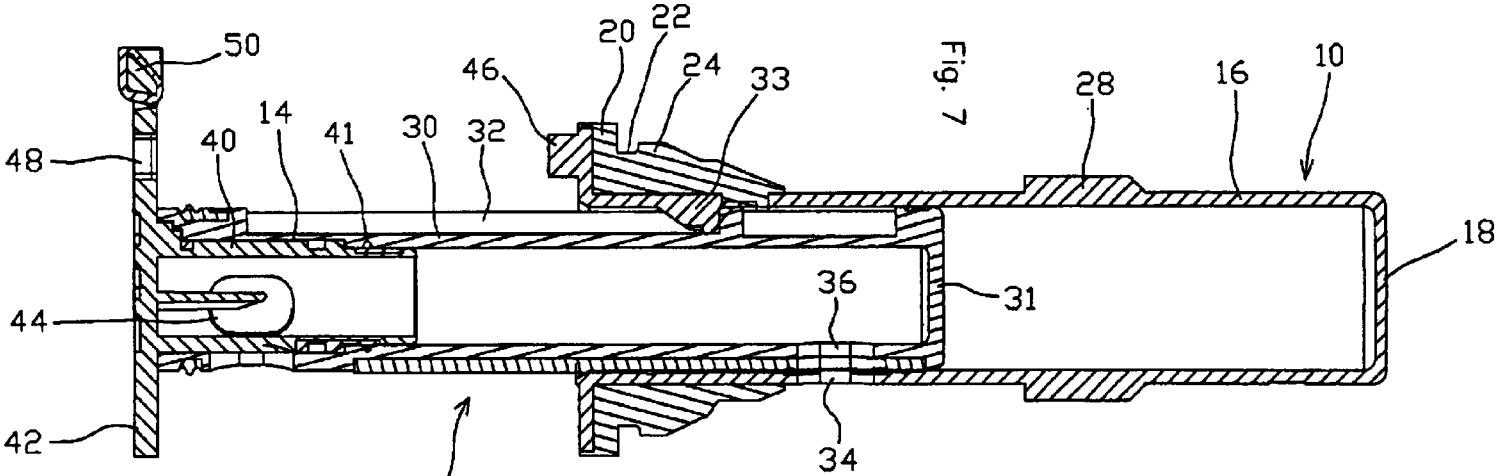

FIG. 7 a cross-section through the tap along B—B of FIG. 6.

The tap is made up of three parts. It consists of a tap bushing 10, a piston 12, and a locking bushing 14.

The tap bushing 10 has a circular cylindrical beaker body 16, the bottom 18 of which is closed off at its inner end. At the outer end of the tap bushing 10, a conically widening bunghole made of elastic material is molded on, which has a flange-like outer contact part 20, a circumferential sealing part 22 behind it, decreasing in size, and a circumferential conical catch part 24 located in front of the sealing part 22, the diameter of which is greater than that of the sealing part 22.

The tap according to the invention is pressed into the round opening of a container to be emptied, which contains a liquid, as a completely pre-assembled unit consisting of the tap bushing 10, the piston 12, and the locking bushing 14. This liquid is a liquid that has been packaged without pressure or under pressure, and can contain carbon dioxide. What is particularly involved is tapping beverages, particularly beer, from barrels, small barrels (party barrels), or cans. The tap is pressed into the round opening of the container in question with the beaker body 16 and the conical catch part 24 of the tap bushing 10 first. The circumferential sealing part 22 holds the edge of the opening, forming a seal, so that it comes to rest between the flange-like contact part 20 and the catch part 24 of the tap bushing 10, with which the latter catches into the edge of the opening.

In order to align the tap bushing 10 in the opening of the container and to secure it against rotation, the conical catch part 24 of the tap bushing 10 is provided with a flattened area 26. Furthermore, ribs 28 that serve for alignment and security against rotation are molded onto the outside mantle of the beaker body 16.

The piston 12 is held so as not to rotate and to move axially in the tap bushing 10. The piston 12 has a circular cylindrical beaker body 30, the bottom 31 of which is closed off at its inner end. The outer end of the piston 12 is open.

An axial dead-end groove 32 on the mantle of the piston 12 serves to prevent rotation of the piston 12 in the tap bushing 10. The dead-end groove 32 does not reach all the way to the inner end of the piston 12, whose mantle is completely cylindrical at this location.

A cam 33 engages in the dead-end groove 32, which cam is molded onto the flange-like contact part 20 of the tap bushing 10. When the piston 12 is inserted into the tap bushing 10, the cam 33 is elastically deformed by the fully cylindrical end of the piston 12, until it springs into the dead-end groove 32 and catches there. This secures the piston 12 to prevent rotation in the tap bushing 10. The axial extension length of the piston 12 out of the tap bushing 10 is limited by the stop of the cam 33 against the groove base of the dead-end groove 32.

The beaker body 16 of the tap bushing 10 is provided with a passage opening 34 for the liquid directly behind the conical catch part 24. The passage opening 34 is located at the bottom of the tap bushing 10 that is appropriately aligned in the opening of the container.

The beaker body 30 of the piston 12 has an entry opening 36 at its inner end and an exit opening 38 for the liquid at its outer end. The openings 36, 38 are located on the bottom of the piston 12 that is axially guided in the tap bushing 10. They lie in a common radial plane.

When the piston 12 is moved into the tap bushing 10, it closes off the passage opening 34 of the tap bushing 10, forming a seal. An elastic insert at the mantle of the piston 12, which is molded onto the piston using two-component injection-molding technology, serves as the seal.

When the piston 12 is moved out, a connection is produced between the passage opening 34 of the tap bushing 10 and the entry opening 36 of the piston 12. In the maximum extension position of the piston 12, the openings 34, 36 cover one another completely.

The locking bushing 14 sits in the open outer end of the piston 12, so that it covers its exit opening 38. The locking bushing 14 has a cylindrical beaker body 40 with a flange-like shield 42 at the outer bottom.

The locking bushing 14 sits in the outer end of the piston 12 with the cylindrical beaker body 40, fixed axially and rotating within the limits defined by stops. It is sealed with regard to the piston 12 by means of a ring bead 41 that is molded onto the cylindrical beaker body 40. A dead-end groove that extends in the circumference direction on the outside mantle of the cylindrical beaker body 40 serves for axial securing and for limiting the angle of the rotational adjustment, and a cam that is molded onto the piston 12 engages in this groove. When the locking bushing 14 is inserted into the piston 12, the cam is elastically deformed until it springs into the dead-end groove and catches there. This fixes the locking bushing 14 in place axially in the piston 12. The angle of rotation of the locking bushing 14 is limited towards both sides by the contact of the cam against the ends of the dead-end groove.

It is understood that a circumferential groove can also be provided on the inside mantle of the piston 12, and a cam on the locking bushing 14, in order to achieve axial fixation and rotational adjustability within a limited angle.

The locking bushing 14 has a locked position in the piston 12, in which it tightly closes off the exit opening 38 of the piston 12. An elastic insert at the outside mantle of the locking bushing 14, which is molded on using two-component injection-molding technology, serves as the seal.

The cylindrical beaker body 40 of the locking bushing 14 is provided with a passage opening 44 for the liquid, which can be brought into connection with the exit opening 38 of the piston 12 by rotating the locking bushing 14. In the contact-limited farthest possible open position of the locking bushing 14, the exit opening 38 of the piston 12 and the passage opening 44 of the locking bushing 14 fully cover one another.

When the piston 12 is completely moved into the tap bushing 10, the flange-like shield 42 of the locking bushing 14 comes into flush contact with the flange-like contact part 20 of the tap bushing 10, on the outside. A lead seal 46 is molded onto the contact part 20, which projects through an opening 48 in the shield 42 and tears off the first time the piston 12 is pulled out. This provides originality protection.

A handle stirrup 50 is divided off from the shield 42, and serves for axial activation of the piston 12 and for rotational activation of the locking bushing 14. The handle stirrup 50 can be bent up from the shield 42. Its coupling locations are designed so that they discolor when they are bent up for the first time. This serves for originality protection.

The handle stirrup 50 is provided with a covering that is molded onto it using two-component injection-molding technology. The surface of this covering can be textured in a manner so as to improve its feel; in particular, it can be provided with ribs or ridges.

The handle stirrup 50 has a connection with the flange-like contact part 20 of the tap bushing 10 at several predetermined breaking points. The connection consists of the elastic material of the covering. This serves for ease of operation and originality protection.

LIST OF REFERENCE SYMBOLS

10 tap bushing
12 piston
14 locking bushing
16 beaker body
18 bottom
20 contact part
22 sealing part
24 catch part
26 flattened area
28 rib
30 beaker body
31 bottom
32 dead-end groove
33 cam
34 passage opening
36 entry opening
38 exit opening
40 cylindrical beaker body
41 ring bead
42 shield
44 passage opening
46 lead seal
48 opening
50 handle stirrup

What is claimed is:

1. Tap for discharging liquid from a container, with a tap bushing that can be set into an opening in said container, with a seal, said tap bushing is provided with a passage opening for said liquid, and with a piston guided so as to move axially within said tap bushing, said piston has an entry opening and an exit opening for said liquid, whereby said piston closes off the passage opening of said tap bushing in a locked position when it is moved into said tap bushing, and whereby said entry opening of the piston is in connection with said passage opening of said tap bushing in an extended position of said piston, in which it is moved out of said tap bushing, and a flow path through said piston can be released and blocked off by means of rotational activation, wherein a locking bushing that is guided to rotate on said piston is seated in said piston, said locking bushing has a passage opening and can be rotated from a locked position in which it closes off said exit opening of said piston, into a release position in which said exit opening of said piston is in connection with said passage opening, and can be rotated back to a locked position closing off said exit opening of said piston.

2. Tap according to claim 1, wherein said entry opening and said exit opening of said piston lie on its bottom in a common radial plane.

3. Tap according to claim 1, wherein said piston has a contact stop to limit its extended position out of the tap busting.

4. Tap according to claim 1, wherein said locking bushing is limited by a contact stop that limits its rotational movement in said piston, towards both sides.

5. Tap according to claim 1, wherein a shield is provided on said outer face of said locking bushing, and a handle stirrup is divided from this shield.

6. Tap according to claim 5, wherein said handle stirrup is provided with an elastic covering.

7. Tap according to claim 6, wherein said covering is textured on its surface, in such a way as to improve its feel, particularly it is provided with ribs or ridges.

8. Tap according to claim 6, wherein said covering is molded onto said handle stirrup using two-component injection-molding technology.

9. Tap according to claim 6, wherein said handle stirrup is connected to said tap bushing at at least one predetermined breaking point, and that said connection consists of said elastic material of said covering.

10. Tap according to claim 2, wherein said piston has a contact stop to limit its extended position out of said tap bushing.

11. Tap according to claim 2, wherein said locking bushing is limited by a contact stop that limits its rotational movement in the piston, towards both sides.

12. Tap according to claim 3, wherein said locking bushing is limited by a contact stop that limits its rotational movement in the piston, towards both sides.

13. Tap according to claim 2, wherein a shield is provided on the outer face of said locking bushing, and a handle stirrup is divided from this shield.

14. Tap according to claim 3, wherein a shield is provided on the outer face of said locking bushing, and a handle stirrup is divided from this shield.

15. Tap according to claim 4, wherein a shield is provided on the outer face of said locking bushing, and a handle stirrup is divided from this shield.

16. Tap according to claim 7, wherein said covering is molded onto said handle stirrup using two-component injection-molding technology.

17. Tap according to claim 7, wherein said handle stirrup is connected to said tap bushing at at least one predetermined breaking point, and that said connection consists of said elastic material of said covering.

18. Tap according to claim 8, wherein said handle stirrup is connected to said tap bushing at at least one predetermined breaking point, and that said connection consists of said elastic material of said covering.

* * * * *